US007056201B2

(12) United States Patent
Jespersen

(10) Patent No.: US 7,056,201 B2
(45) Date of Patent: Jun. 6, 2006

(54) CYLINDRIC DRUM WITH SANDING ELEMENTS

(76) Inventor: Poul Erik Jespersen, Lyngvænget 6, Roslev (DK) 7870

( * ) Notice: Subject to any disclaimer, the term of this patent is extended or adjusted under 35 U.S.C. 154(b) by 0 days.

(21) Appl. No.: 10/513,685

(22) PCT Filed: May 6, 2003

(86) PCT No.: PCT/DK03/00297

§ 371 (c)(1),
(2), (4) Date: Nov. 8, 2004

(87) PCT Pub. No.: WO03/095148

PCT Pub. Date: Nov. 20, 2003

(65) Prior Publication Data

US 2005/0148293 A1 Jul. 7, 2005

(30) Foreign Application Priority Data

May 7, 2002 (DK) ..... 2002 00689

(51) Int. Cl.
*B24B 7/06* (2006.01)

(52) U.S. Cl. ..... 451/465; 451/466; 451/469

(58) Field of Classification Search ..... 451/465–469
See application file for complete search history.

(56) References Cited

U.S. PATENT DOCUMENTS 1,643,459 A * 9/1927 Johnson ..... 451/484
2,804,730 A 9/1957 Block
2,978,845 A * 4/1961 Haven et al. ..... 451/469
3,053,021 A * 9/1962 Block ..... 451/469
3,116,575 A * 1/1964 Block ..... 451/469
3,381,419 A * 5/1968 Johnson ..... 451/465
3,512,311 A * 5/1970 Block ..... 451/468
3,678,633 A * 7/1972 Block ..... 451/469
3,872,630 A 3/1975 Ali
5,216,847 A * 6/1993 Scheider et al. ..... 451/463
5,301,472 A 4/1994 Lyng
6,254,467 B1 * 7/2001 Prosl ..... 451/465

FOREIGN PATENT DOCUMENTS

| | | |
|---|---|---|
| DE | 1234186 | 2/1967 |
| DE | 29608280 | 8/1996 |
| DK | 9500184 | 5/1995 |
| NL | 71228 | 11/1952 |
| SE | 510251 | 5/1999 |
| WO | WO 01/76824 | 10/2001 |

* cited by examiner

*Primary Examiner*—M. Rachuba
(74) *Attorney, Agent, or Firm*—James Creighton Wray

(57) ABSTRACT

The invention concerns a cylindric drum for a sanding/polishing tool which in its drum surface is provided with a number of undercut axial grooves for mounting one or more axially displaceable sanding elements, where an annular groove has been provided either in the drum surface or a shaft perpendicularly to the rotational axis of the cylindric drum and along the periphery of either the surface of the drum or the surface of the shaft, that a stop means has been arranged for accommodation in the annular groove in an axially fixed position, where at least a part of the stop means abuts on end faces of the moldings of the sanding elements mounted in the axial undercut grooves.

5 Claims, 3 Drawing Sheets

CYLINDRIC DRUM WITH SANDING ELEMENTS

Figure 1:
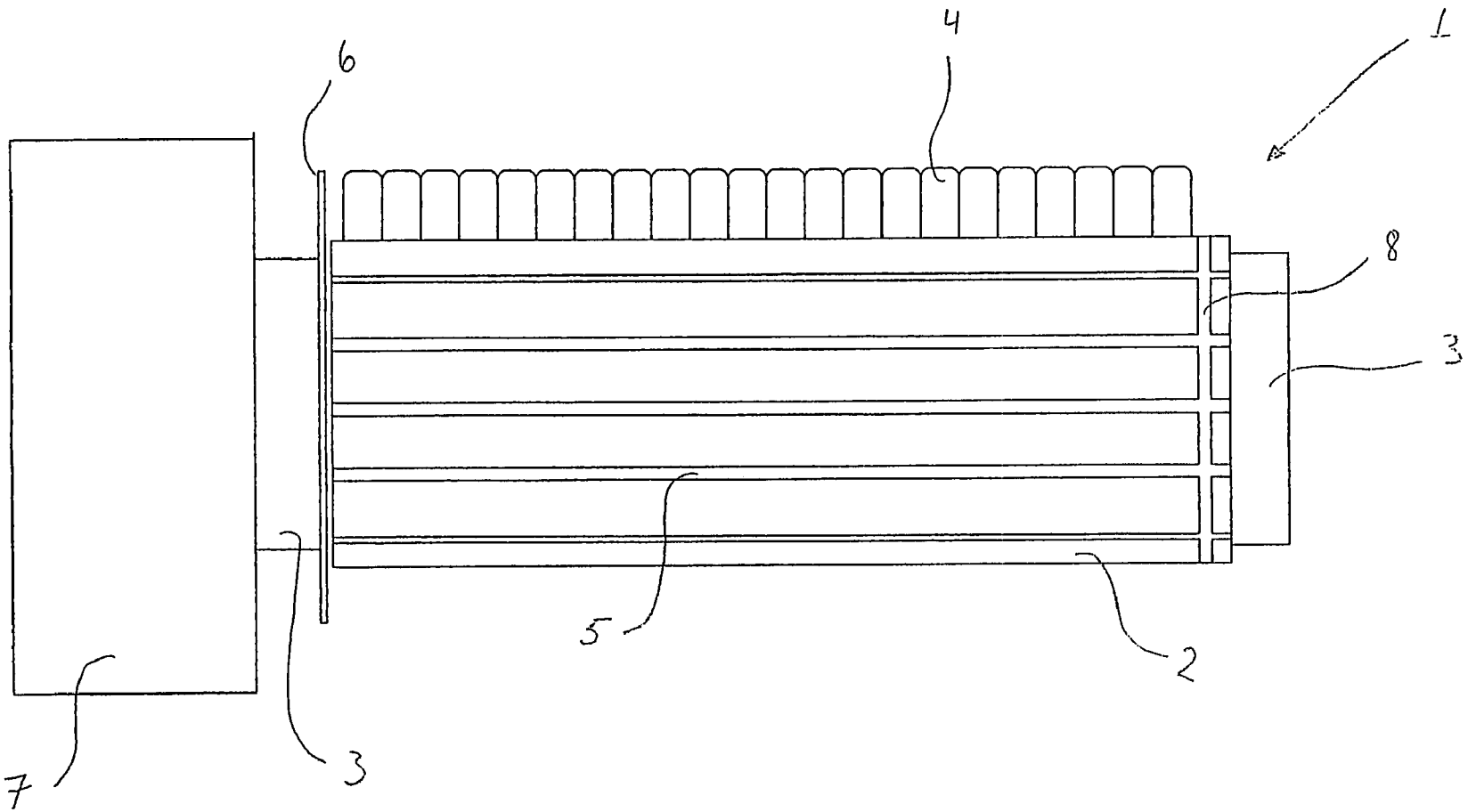

This application claims the benefit of Danish Application No. PA 2002 00689 filed May 7, 2004 and PCT/DK02/00297 filed May 6, 2003.

FIELD OF THE INVENTION

The present invention concerns a cylindric drum for a sanding/polishing tool which in its drum surface is provided with a number of undercut axial grooves for mounting one or more axially displacing sanding elements.

BACKGROUND OF THE INVENTION

By using cylindric drums for sanding/polishing tools having undercut and through-going grooves in the surface of the cylindric drum, thus enabling fitting and replacing sanding elements sliding longitudinally, it is necessary that the longitudinally displacing sanding elements are held in place during use of the sanding/polishing tool.

Normally, at one end of the cylindric drum there will be an arrangement with a plate and a means for fastening the cylindric drum to a drive unit, e.g. a gearbox and/or a motor. At the other end of the cylindric drum there will be a second arrangement with a releasable plate and possibly a means for fastening the cylindric drum to a support unit.

However, this has the drawback that in order to replace the sanding elements in the cylindric drum, the arrangement with the releasable plate has to be taken apart, which may be cumbersome and time-consuming.

SUMMARY OF THE INVENTION

OBJECT OF THE INVENTION

It is therefore the purpose of the invention to provide a cylindric drum that enables secure retention of the longitudinally displacing sanding elements during use of the sanding/polishing tool and which by replacement of the sanding elements is easily and rapidly operated.

This may be achieved with a cylindric drum being characterised in that an annular groove has been provided either in the drum surface or a shaft perpendicularly to the rotational axis of the cylindric drum and along the periphery of either the surface of the drum or the surface of the shaft, that a stop means has been arranged for accommodation in the annular groove in an axially fixed position, where at least a part of the stop means abuts on end faces of the mouldings of the sanding elements mounted in the axial undercut grooves.

DESCRIPTION OF THE INVENTION

Alternatively, this may be achieved with one cylindric drum being characterised in that there is provided an elastic means with bearing against the drum surface or the shaft surface and preferably perpendicularly to the rotational axis of the cylindric drum and along the periphery of either the drum surface or the surface of the shaft, where at least a part of the elastic means abuts on a part of the mouldings of the sanding elements that are mounted in the axial, undercut grooves.

In order to achieve securing of longitudinally displacing mouldings in the undercut axial grooves in the cylindric drum, the drum is designed with an annular groove perpendicularly to the rotational axis of the cylindric drum and along the periphery of either the drum surface or the shaft surface in which it is possible to provide a stop means arranged to be accommodated in the annular groove in an axially fixed position. As at least a part of the stop means is in contact with end faces of the sanding element mouldings mounted in the axially undercut grooves, these cannot move.

If the annular groove is disposed in the drum surface, it will cross all the undercut axial grooves in the drum surface, and the sanding elements are adapted so that they have a length corresponding to the length from one end of the cylindric drum and to the undercut groove.

If the annular groove is disposed in the surface of the shaft of the cylindric drum, it will be in immediate continuation of all the undercut axial grooves, and the sanding elements are adapted so that they have a length corresponding to the length of the cylindric drum.

In an alternative embodiment, there will only be provided two annular grooves perpendicularly to the cylindric shaft and along the periphery, either in immediate vicinity of each end of the drum surface, or in the shaft surface at each side of the cylindric drum.

In order to achieve secure fastening of the sanding elements, the stop means and the annular groove are designed so that the stop means by disposition in the annular groove are secured in axial direction.

Depending on how the annular groove has been designed and which stop means used, there are two possibilities: either an annular groove with stop means filling the entire annular groove, or an annular groove with a stop means filling the annular groove and extending outside the annular groove.

The most important concerning the stop means is, however, that at least a part of it is abutting on the end faces of the mouldings of the sanding elements. This provides that the shape and depth of the annular groove is depending on which type of stop means is used.

In one embodiment, the stop means is an elastic device, where the elastic device is e.g. an O-ring and/or a lock ring.

The elastic O-ring is preferably made of rubber, but may alternatively be made of plastic material, a metal alloy and/or a textile. The only requirement is that the O-ring by placing in the annular groove is to tighten around the annular groove so that it is secured during rotation of the cylindric drum, and it is possible to expand the O-ring sufficiently enough that it may be removed from the annular groove when a replacement of the sanding elements is to take place.

If the stop means is an elastic lock ring, this has to be designed so that it is possible to expand the lock ring so much that it may be mounted and dismounted in the annular groove. The lock ring may typically be made of spring steel, or another metal alloy and/or plastic mixture having resilient action.

If further space may be provided in the longitudinal direction of the cylindric drum, a replacement of the mouldings may take place, while the cylindric drum is suspended between a drive unit and a possible support unit.

Alternatively, in an embodiment there may be used a strap which is placed and clamped in the annular groove. In order to replace the longitudinally displacing sanding elements, the strap may typically be broken. This provides that the strap is to be produced inexpensively and not be complicated This strap may e.g. be a clamp, a rubber band, a cord, and/or a strip.

In an alternative embodiment for retaining the sanding element moulds, the cylindric drum is designed so that the cylindric drum for a sanding/polishing tool is provided in its drum surface with a number of undercut axial grooves for mounting one or more axially displacing sanding elements, and where there is provided an elastic means with bearing against the drum surface or the shaft surface and preferably perpendicularly to the rotational axis of the cylindric drum and along the periphery of either the drum surface or the surface of the shaft, where at least a part of the elastic means abuts on a part of the mouldings of the sanding elements that are mounted in the axial, undercut grooves.

This embodiment of the cylindric drum will be applied when using sanding/polishing tools employing cylindric drums with large diameter and/or have significant length. Instead of making the cylindric drum with a groove, it will be easy to use an elastic means which by means of an axial contraction, elasticity and friction will retain the moulds of the sanding elements in the undercut grooves in the cylindric drum.

If the elastic means is disposed on the drum surface, it will be placed in immediate vicinity of the end which is not coupled to a drive unit.

If the elastic means is disposed on the shaft surface, it will be placed in immediate vicinity of the outlet from the axial undercut groove in the cylindric drum, so that at least a part of the elastic is abutting on the end face on the sanding element moulds that are mounted in the axial undercut grooves.

The elastic means may e.g. be one or more of the following: an elastic band, a rubber band and/or a textile. However, by mounting on the drum surface or the shaft surface it is to provide axial contraction so that the elasticity and the friction may retain the sanding element moulds in the undercut groove of the cylindric drum without they being provided a longitudinally displacing movement.

SHORT DESCRIPTION OF THE DRAWINGS

Figure 2:
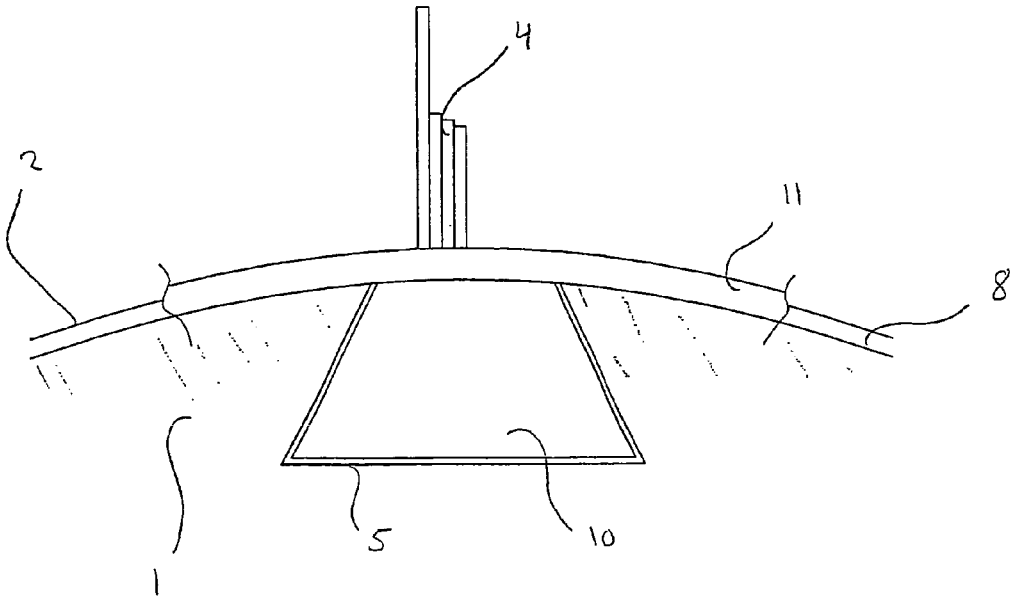
Figure 3:
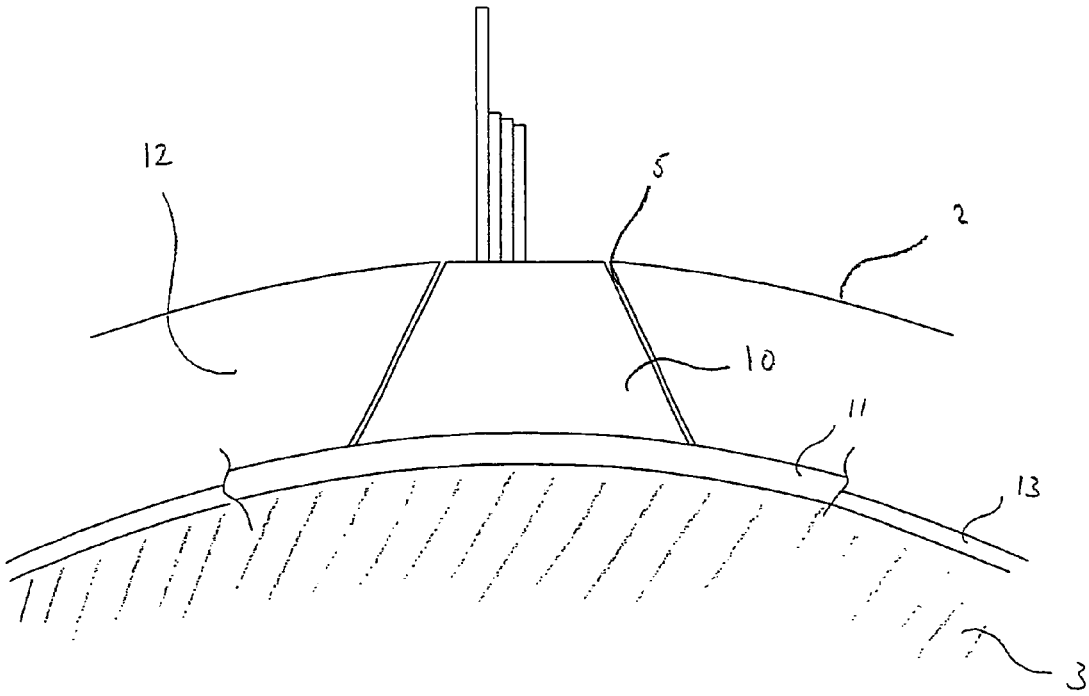
Figure 4:
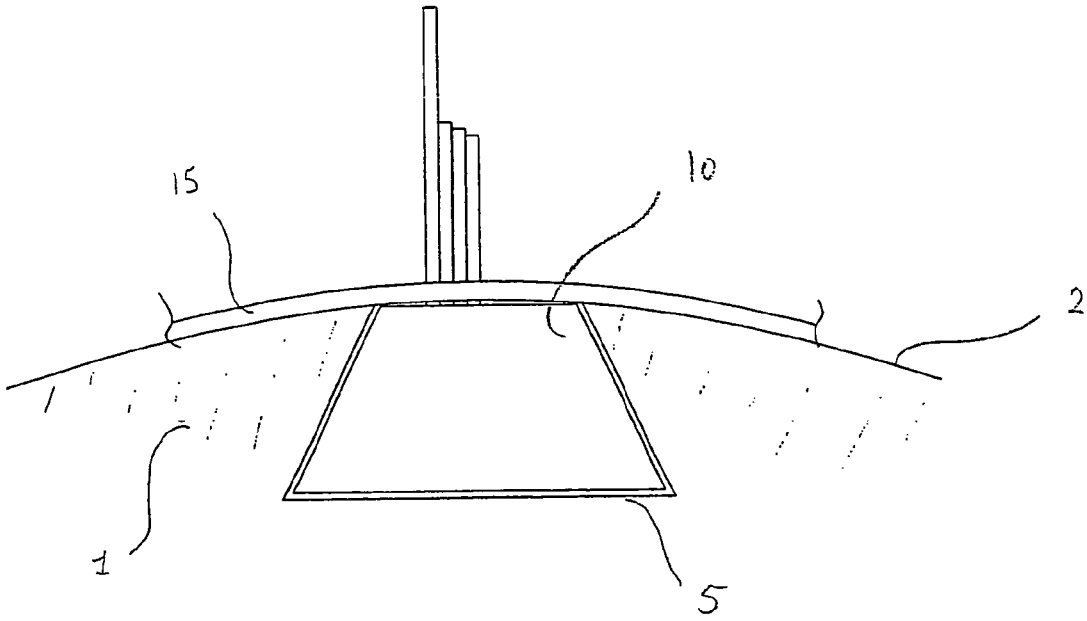

The invention is explained in more detail below with reference to the drawings, in which:

FIG. 1 shows a sectional side view of a cylindric drum according to the invention, FIG. 2 shows a section of a cylindric drum according to the invention, FIG. 3 shows a section of a cylindric drum according to the invention, and FIG. 4 shows a section of a cylindric drum according to the invention.

DETAILED DESCRIPTION OF THE DRAWINGS

The perspective view shown in FIG. 1 of a cylindric drum 1 shows that a cylindric drum 1 includes a drum surface 2 and a shaft 3. On the drum surface 2 there are provided a number of undercut grooves 5 in which are mounted moulds (not shown) with sanding elements 4.

In the embodiment shown, a groove 8 is provided in the drum surface 2 in vicinity of the edge of the cylindric drum 1. The groove 8 is crossing all undercut axial grooves 5.

One end of the cylindric drum is connected to an end plate 6 providing that the moulds (not shown) with the sanding elements 4 cannot be longitudinally displaced further than to the plate 6. In connection with the plate 6 and the shaft 3 there is mounted a drive unit 7. The opposite end of the cylindric drum 1 is shown as a free end with a projecting shaft 3. The cylindric drum and/or the shaft 3 may be connected to a support unit (not shown).

On FIG. 2 is shown a cross-section of the cylindric drum 1 in which an undercut groove 8 is crossing the axial groove 5. In the groove 8 is placed an O-ring 11 acting as a stop for axial movement of the mould 10. In the shown embodiment, the shape of the groove 8 is so that the O-ring 11 is fitting into the groove 8 while the upper part of the O-ring 11 is free of the groove 8.

As shown on FIG. 2 it is only a part of the O-ring 11 which is used as stop against the movement of the mould 10 in the undercut groove 5. It is dependent on the depth of the groove 8 how great a part of the O-ring 11 that is used for stop, but the deeper groove 8, the more difficult it may be to remove the O-ring 11 from the groove 8.

On FIG. 3 is shown an alternative embodiment for securing the longitudinally displacing moulds 10. Grooves 13 are provided in shaft 3 immediately opposite the end piece 12 of the cylindric drum 1 so that an O-ring 11 mounted in groove 13 forms a stop for the mould 10 in the undercut groove 5.

In this embodiment it is important that groove 13 is designed so that the O-ring will have a free part protruding up and covering a part of the mould 10, thereby forming a stop for longitudinally displacing movements.

On FIG. 4 is shown a cross-section of a cylindric drum 1 with a drum surface 2, where an elastic means 15 is provided for retaining the sanding element mould 10 and which by means of axial contraction, elasticity and friction retains the sanding element mould 10 in the undercut groove 5 of the cylindric drum 1.

The invention is not limited to the embodiments shown and described above in the Figures. Other embodiments including other embodiments of grooves and elastic means are possible within the scope of this invention and the matter specified in the claims.

The invention claimed is:

1. Cylindric drum for a sanding/polishing tool which in its drum surface is provided with a number of undercut axial grooves for mounting one or more axially displaceable sanding elements, each comprising a molding adapted for mounting in the undercut axial groove, wherein an annular groove has been provided either in the drum surface or a shaft perpendicularly to the rotational axis of the cylindric drum and along the periphery of either the surface of the drum or the surface of the shaft, that a stop means has been arranged for accommodation in the annular groove in an axially fixed position, where at least a part of the stop means abuts on end faces of the molding of the sanding elements mounted in the axial undercut grooves.

2. Cylindric drum according to claim 1, wherein the stop means in the annular groove is an elastic device.

3. Cylindric drum according to claim 2, wherein the elastic device is an O-ring.

4. Cylindric drum according to claim 2, wherein the elastic means is a locking ring.

5. Cylindric drum for a sanding/polishing tool which in its drum surface is provided with a number of undercut axial grooves for mounting one or more axially displacing sanding elements, each comprising a molding adapted for mounting in the undercut axial groove, wherein there is provided an elastic means bearing against the drum surface or the shaft surface and preferably perpendicularly to the rotational axis of the cylindric drum and along the periphery of either the drum surface or the surface of the shaft, where at least a part of the elastic means abuts on a part of the molding of the sanding elements that are mounted in the axial, undercut grooves.

* * * * *

UNITED STATES PATENT AND TRADEMARK OFFICE

CERTIFICATE OF CORRECTION

PATENT NO. : 7,056,201 B2
APPLICATION NO. : 10/513685
DATED : June 6, 2006
INVENTOR(S) : Poul Erik Jespersen It is certified that error appears in the above-identified patent and that said Letters Patent is hereby corrected as shown below:

Column 1, lines55 and 6 should read:

--No. PA 2002 000689 filed May 7, 2002 and PCT/DK03/00297 filed May 6, 2003.--

Signed and Sealed this

Fifth Day of September, 2006

JON W. DUDAS
*Director of the United States Patent and Trademark Office*